US005088781A

United States Patent [19]

Ono et al.

[11] Patent Number: 5,088,781

[45] Date of Patent: Feb. 18, 1992

[54] HANDLE STRUCTURE

[75] Inventors: Tomio Ono; Hiromi Koyama, both of Kanagawa, Japan

[73] Assignee: Nissan Motor Co., Ltd., Japan

[21] Appl. No.: 638,671

[22] Filed: Jan. 8, 1991

[30] Foreign Application Priority Data

Jan. 10, 1990 [JP] Japan ..... 2-1558

[51] Int. Cl.[5] ..... E05B 3/04

[52] U.S. Cl. ..... 292/347; 292/DIG. 38; 292/DIG. 64; 292/353

[58] Field of Search ..... 74/557; 292/336.3, 347, 292/353, 349, DIG. 38, DIG. 53, DIG. 64, 143, 139; 296/224, 137 B

[56] References Cited

U.S. PATENT DOCUMENTS 89,708 5/1869 Tuthill ..... 292/353
2,295,444 9/1942 Woodward ..... 292/353 X
3,635,512 1/1972 Hansen ..... 292/353
4,786,092 11/1988 Shiraishi et al. ..... 292/DIG. 5 X

*Primary Examiner*—Richard E. Moore
*Attorney, Agent, or Firm*—Leydig, Voit & Mayer

[57] ABSTRACT

A handle structure includes a handle lever and a grip member in latched engagement with the handle lever. The grip member has a recess formed therein and includes a sleeve-like outer member and an inner member received in the outer member. The inner and outer members are detachably engaged with one another, and the inner member is detachably engaged with the handle lever by a latch pawl that engages with a latch opening in the handle lever. The upper latch pawl is exposed to the outside of the grip member through a window opening formed in the outer member and the latch opening. The engagement between the inner member and the handle lever can be released through the window opening.

12 Claims, 5 Drawing Sheets

HANDLE STRUCTURE

BACKGROUND OF THE INVENTION

1. Field of the Invention

The present invention relates, in general, to handle structures for operating manual lock devices, and more particularly, to a handle structure for manual lock devices of a type which locks a detachable hard roof to an open-type sport car or the like.

2. Description of the Prior Art

In open-type sport cars, a detachable hard roof is widely used for converting the cars to roofed sport cars. In this case, lock devices are used for achieving a locked connection of the roof relative to the car body. Usually, such lock devices are mounted on the roof and constructed compactly. More specifically, they are small in thickness for the purpose of improving the external appearance of the roof. For the same reason, handle structures for operating the lock devices are made compact in construction.

However, some of the conventional handle structures have drawbacks due to their structures. Some of the conventional handle structures for such lock devices will be outlined with reference to FIGS. 8 to 13 of the accompanying drawings.

FIGS. 8 to 10 show conventional handle structures of a so-called "integral" type, while, FIGS. 11 and 12 show conventional handle structures of a so-called "two-piece" type.

The handle structure of FIG. 8 comprises a plastic grip member 101 and a handle lever 105 which are integrally assembled. The handle lever 105 extends from an associated lock device (not shown). The grip member 101 is molded to have a considerable thickness "t" by forming an open recess therein. For assembly, the handle lever 105 is thrusted into the grip member 101 in a manner to cover the recess.

However, this handle structure has a poor external appearance because the portion of the handle lever 105 which covers the recess is exposed and a gap is inevitably produced between the grip member 101 and the exposed portion of the handle lever 105 Furthermore, the provision of the gap lowers the ease with which an operator manipulates the handle structure.

The handle structure of FIG. 9 comprises a stepped plastic grip member 101 and a handle lever 105 which are integrally assembled. The grip member 101 is formed with a plurality of lightening holes 103.

However, due to provision of the exposed lightening holes, the external appearance of this handle structure is also poor and it is necessary to use complicated molds for molding the grip member 101.

The handle structure of FIG. 10 comprises a plastic grip member 101 and a handle lever 105. For increasing the mechanical strength, the grip member 101 is molded to have partition walls or beams therein. For assembly, screw bolts are used.

However, since the handle lever 105 is entirely exposed, the external appearance of this handle structure is degraded. Furthermore, use of the screws 107 inevitably increases the number of steps for assembling the handle structure.

The handle structure of FIG. 11 comprises a two-piece grip member 101 and a handle lever 105. The two-piece grip member 101 includes a sleeve-like rigid cover member 109 and a plastic solid core member 111 received in the cover member 109. The two members 109 and 111 are secured by means of welding or a suitable adhesive.

However, in this handle structure, the step for performing welding or bonding of the two members 109 and 111 is troublesome. In fact, if the welding or bonding is not properly carried out, undesirable play of the cover member 109 tends to occur.

The handle structure of FIG. 12 comprises a two-piece grip member 101 and a handle lever 105. The two-piece grip member 101 includes a rigid base member 111 and a plastic cover member 109 which are detachably connected with each other. The base member 111 is formed with hook catchers 113 and the cover member 109 is formed with hooks 115. Upon assembly, the hook catchers 113 catch the hooks 115 to achieve a latched connection between the two members 111 and 109.

However, in this handle structure, undesirable play of the two members 111 and 109 tends to occur due to difficulty in obtaining tight engagement between the hook catchers 113 and the hooks 115.

Furthermore, in the above-mentioned handle structures except that of FIG. 10, it is impossible or at least difficult to dismantle the grip member 101 from the handle lever 105 once they are assembled. Thus, when such handle structures 101 are employed as a handle in the manner as illustrated in FIG. 13, the maintenance of the lock device installed in the housing 119 of the detachable roof 11 is very difficult. In fact, if the grip member 101 is of a type which can be easily dismantled from the handle lever 105, the lock device can be easily removed from the housing 119 for inspection of the lock device.

SUMMARY OF THE INVENTION

It is therefore an object of the present invention to provide a handle structure for lock devices which is free of the above-mentioned drawbacks.

A handle structure according to the present invention comprises a handle lever and a grip member in latched engagement with the handle lever. The grip member has a recess formed therein and includes a sleeve-like outer member and an inner member received in the outer member. The inner and outer members are detachably engaged with one another, and the inner member is detachably engaged with the handle lever by a latch pawl that engages with a latch opening in the handle lever. The upper latch pawl is exposed to the outside of the grip member through a window opening formed in the outer member and the latch opening. The engagement between the inner member and the handle lever can be released through the window opening.

BRIEF DESCRIPTION OF THE DRAWINGS

Other objects and advantages of the present invention will become apparent from the following description when considered in conjunction with the accompanying drawings, in which.

DESCRIPTION OF THE INVENTION

Figure 1:
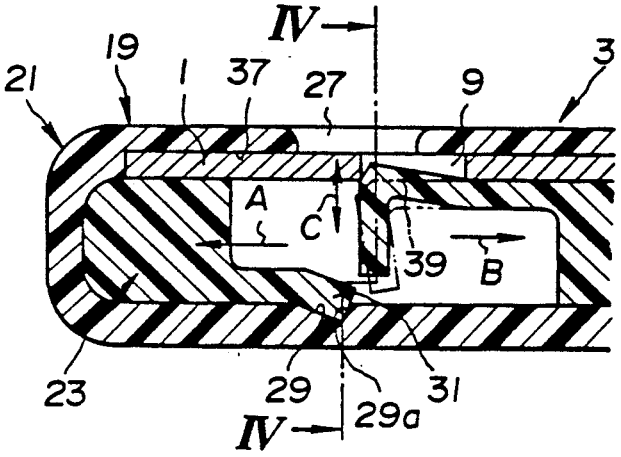
FIG. 1 is a sectional view of a handle structure according to the present invention.

FIGS. 1 to 6 show a handle structure 3 according to the present invention.

In the drawings, reference numeral 1 denotes a handle lever of metal which extends from a lock device installed in a housing 7 (see FIG. 5) which is mounted on a detachable roof 5.

Figure 2:
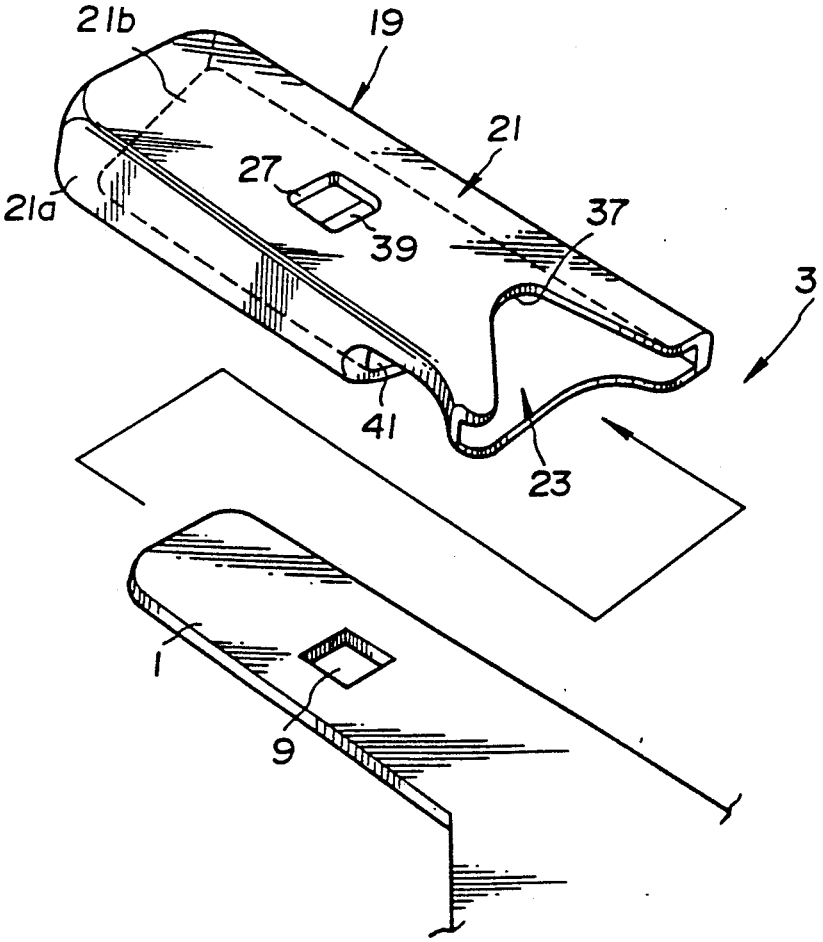
FIG. 2 is an exploded view of the handle structure of the invention.

As is seen from FIG. 2, the handle lever 1 is flat and formed with a rectangular opening 9. The rectangular opening 9 serves as a latch pawl catcher as will become apparent hereinafter.

Figure 5:
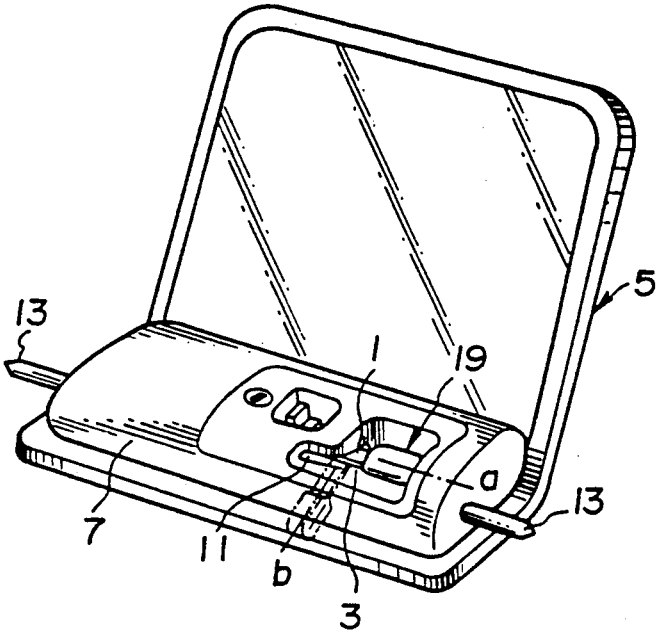
FIG. 5 is a perspective view of a detachable roof to which the handle structure cf the invention is applied.

As is seen from FIG. 5, the handle lever 1 projects through a slit 11 into a recess (no numeral) formed on the housing 7. The handle lever 1 can pivot between a locking position "a" as illustrated by a solid line and an unlocking position "b" as illustrated by a phantom line.

Reference numerals 13 and 13 denote lock pins which are axially movably mounted to axially opposed ends of the housing 7 and linked to the lock device in the housing 7. When the handle structure 3 assumes the locking position "a", the lock pins 13 and 13 are projected, and when the handle structure 3 assumes the unlocking position "b", the lock pins 13 and 13 are withdrawn.

Figure 6:
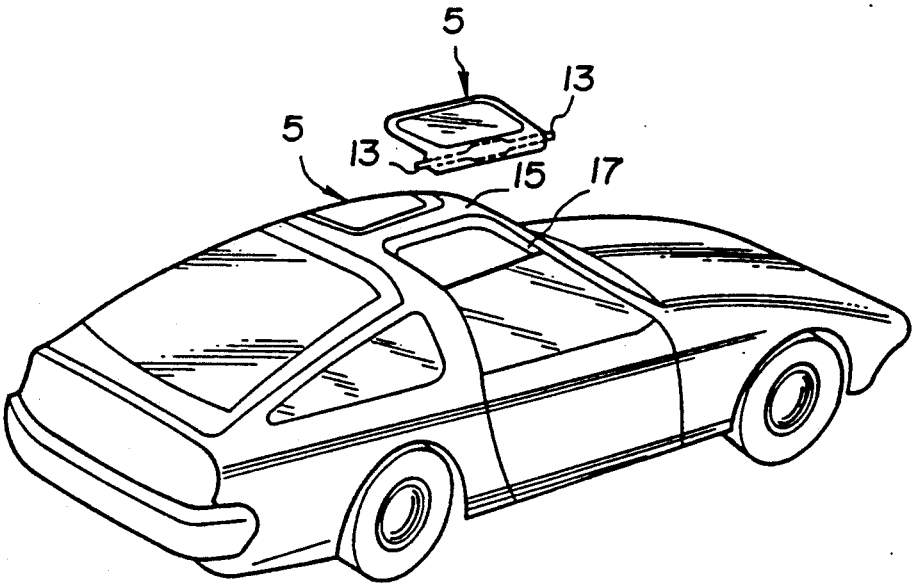
FIG. 6 is a perspective view of an open-type sport car to which the handle structure of the invention is applied.

As is seen from FIG. 6, when, with the detachable roof 5 properly put on the car body, the handle structure 3 is pivoted to the locking position "a", the lock pins 13 and 13 are projected and engaged with respective lock holes 17 and 17 of the car body thereby achieving a locked engagement of the roof 5 relative to the car body.

As is seen from FIGS. 1 and 2, the handle structure 3 according to the present invention comprises a two-piece grip member 19 and the handle lever 1.

Figure 3:
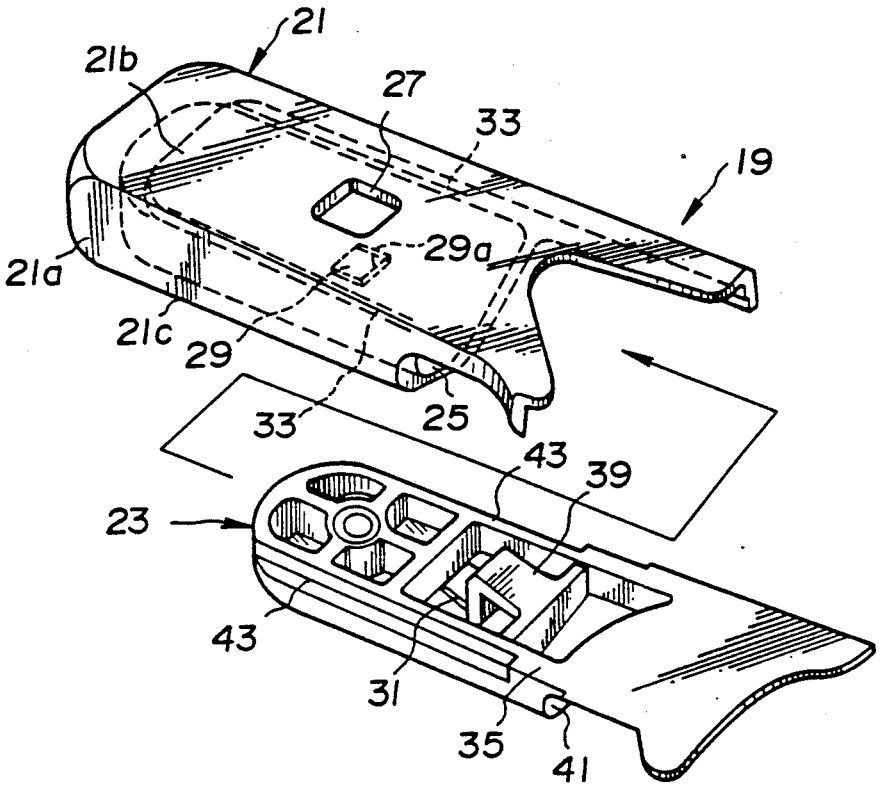
FIG. 3 is an exploded view of a grip member which is part of the handle structure.

As is seen from FIG. 3, the grip member 19 comprises a sleeve-shaped plastic outer member 21 and a plastic inner member 23. As will become apparent as the description proceeds, the inner member 23 is received in the outer member 21 with a latched connection therebetween and with the handle lever 1 sandwiched therebetween.

Figure 4:
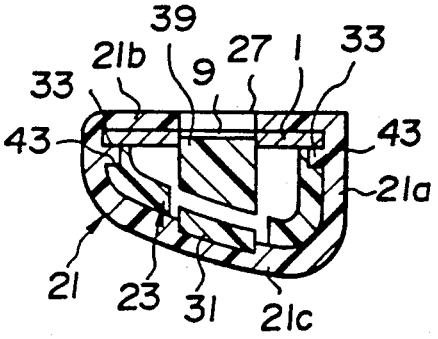
FIG. 4 is a sectional view taken along the line IV—IV of FIG. 1.

As is best seen from FIG. 4, the outer member 21 has a generally triangular cross section and thus comprises a side portion 21*a*, a back portion 21*b* and a front portion 21*c* which are combined to form a sleeve-like configuration. The front portion 21*c* has a convex outer surface.

As is seen from FIG. 3, the sleeve-like outer member 21 has one end 25 opened. The back portion 21*b* is longer than the front portion 21*c* and has a flat inner surface to which the handle lever 1 intimately contacts. The back portion 21*b* is formed with a rectangular window opening 27. The inner surface of the front portion 21*c* is formed, at a portion facing the rectangular window opening 27, with a rectangular recess 29 whose bottom is sloped (see FIG. 1).

As is best seen from FIG. 1, the recess 29 has a latching surface 29*a* with which lower latching pawl 31 is latchingly and detachably engaged.

As is seen from FIG. 4, two guide ridges 33 and 33 are formed on opposed inner surfaces of the outer member 21. These ridges axially in parallel with the flat inner surface of the back portion 21*b*, so that a guide groove is defined between each guide ridge 33 and the back portion 21*b*.

The plastic inner member 23 is so shaped as to be neatly received in the outer member 21. That is as is seen from FIG. 3, the inner member 23 comprises a core body 35 which has a frame-like structure. When the inner member 23 is properly received in the outer member 21, the upper surface cf the inner member 23 faces the inner flat surface of the back portion 21*b* of the outer member 21 with a thin flat clearance 37 defined therebetween Upon assembly, the clearance 37 accommodates the handle lever 1.

The core body 35 is integrally formed with an upper latching pawl 39 which is latchingly engageable with the latch opening 9 of the handle lever 1, a lower latching pawl 31 which is latchingly engageable with the recess 29 of the front portion 21*c* of the outer member 21, a wall portion 41 which closes the opening 25 of the end of the outer member 21 and two opposed guide grooves 43 and 43 which are slidably engaged with the guide ridges 33 and 33 of the outer member 21.

As is understood from FIG. 1, the upper latching pawl 39 is resiliently movable in the directions of the arrow "C" and so shaped that, when engaged with the latch opening 9 of the handle lever 1, the movement of the handle lever 1 in the direction of the arrow "B" relative to the grip member 19 (that is, in the direction to draw the handle lever 1 from the clearance 37) is suppressed. It is however to be noted that the upper latching pawl 39 permits the movement of the handle lever 1 into the clearance 37. The upper latching pawl 39 is constantly biased upward and thus when no external force is applied it projects upwardly beyond a major upper surface of the core body 35. The lower latching pawl 31 is so shaped that, when engaged with the recess 29 of the outer member 21, the movement of the inner member 23 in the direction of the arrow "B" relative to the outer member 21 (that is, in the direction to draw the inner member 23 from the outer member 21) is suppressed. It is however to be noted that the the lower latching pawl 31 permits the movement of the inner member 23 into the outer member 21.

As is understood from FIG. 1, when the grip member 19 (viz., the outer member 21 and the inner member 23) and the handle lever 1 are properly assembled, the upper latching pawl 39 engaged with the latch opening 9 of the handle lever 1 is exposed to the rectangular window opening 27 of the outer member 21.

Thus, the upper latching pawl 39 can be manipulated by a suitable tool through the window opening 27.

Figure 7:
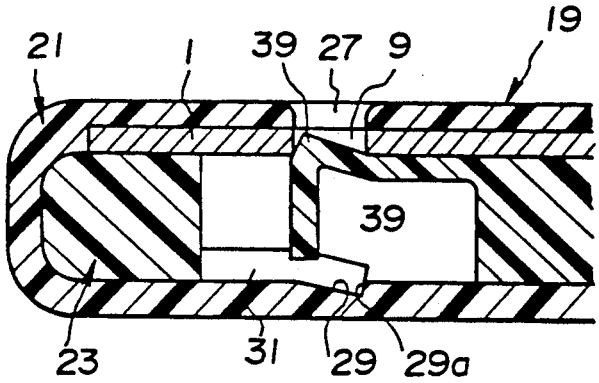
FIG. 7 is a view similar to FIG. 1, but showing a modification of the handle structure of the present invention.
Figure 8:
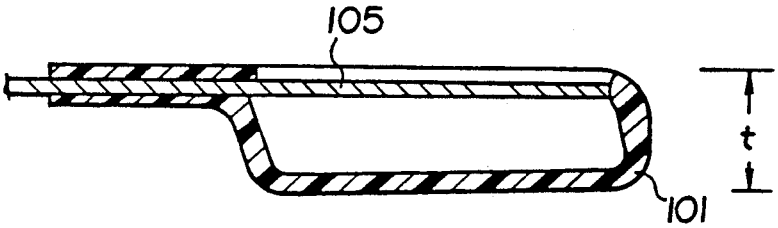
FIG. 8 (Prior Art)
FIGS. 8 to 12 are views of various conventional handle structures.
Figure 9:
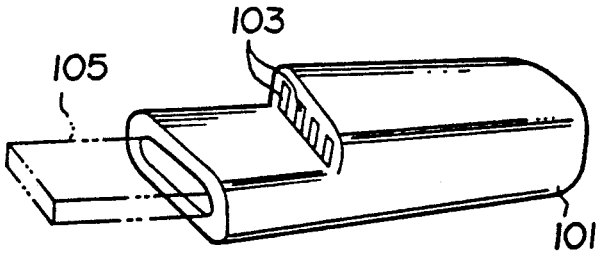
FIG. 9 (Prior Art)
Figure 10:
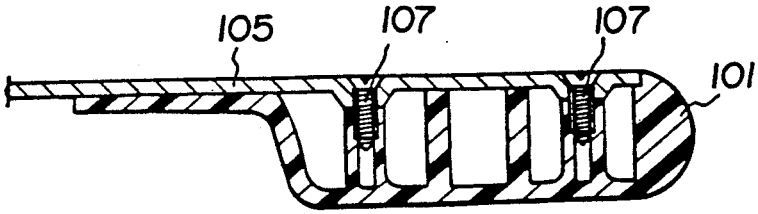
FIG. 10 (Prior Art)
Figure 11:
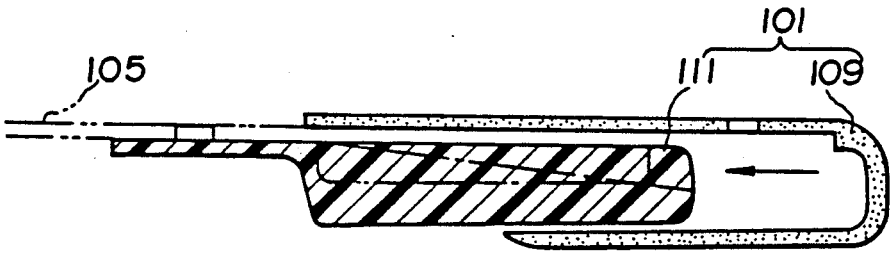
FIG. 11 (Prior Art)
Figure 12:
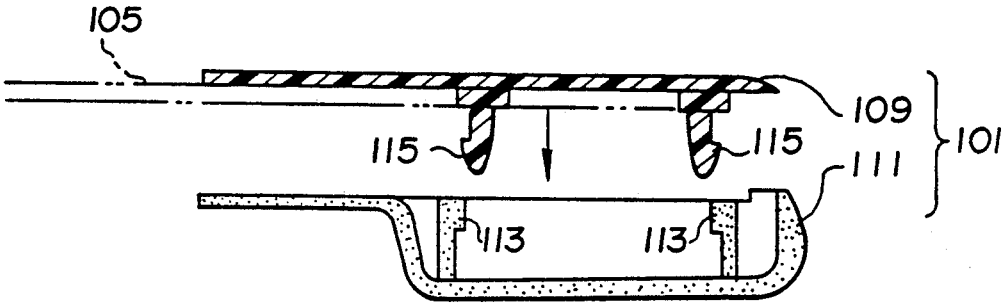
FIG. 12 (Prior Art)
Figure 13:
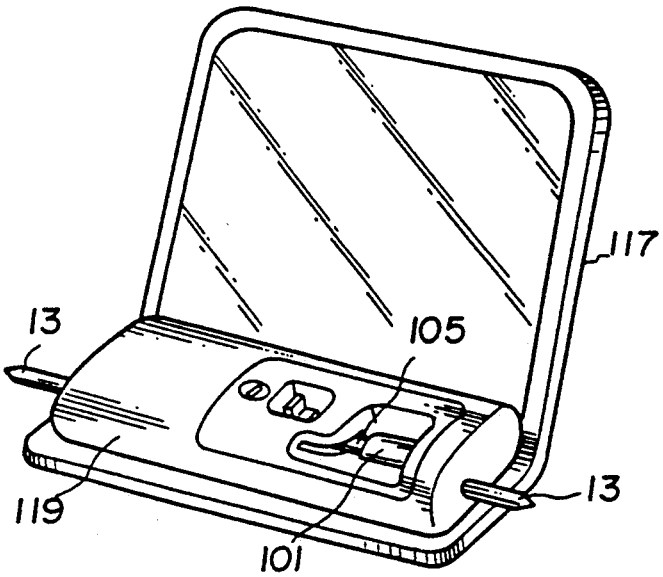
FIG. 13 (Prior Art)
FIG. 13 is a view similar to FIG. 5, but showing a detachable roof to which a conventional handle structure is applied.

If desired, as is shown in FIG. 7, the position of the recess 29 of the outer member 21 may be changed. Of course, in this case, the length of the lower latching pawl 31 changes for achieving the proper engagement of the pawl 31 with the recess 29.

In the following, steps for assembling the handle structure of the invention will be described.

First, as is understood from FIG. 3, the inner member 23 is inserted into the outer member 21. This insertion is smoothly carried out because of the sliding engagement between the guide grooves 43 of the inner member 23 and the guide ridges 33 of the outer member 21. When the inner member 23 comes to a proper position in the outer member 21, the lower latching pawl 31 falls into the recess 29 thereby achieving a latched engagement between the inner and outer members 23 and 21. As a result, the grip member 19 is assembled with the thin flat clearance 37 remained therein The opening 25 of the outer member 21 is neatly closed by the wall portion 41 of the inner member 23.

Then, the handle lever 1 is inserted into the thin flat clearance 37 of the grip member 19. When the handle lever 1 comes to a proper position in the clearance 37, the upper latching pawl 39 of the inner member 23 falls into the latch opening 9 of the handle lever 1 thereby achieving a latched engagement between the grip member 19 and the handle lever 1. As a result, the handle structure is properly assembled.

When dismantling of the grip member 19 from the handle lever 1 is needed, the upper latching pawl 39 is pressed down to a position to disengage from the latch opening 9 of the handle lever 1 by a suitable tool (such as a pick or the like) which passes through the window opening 27 of the grip member 19 and then, with the pawl 39 kept pressed down with the tool, the grip member 19 is pulled strongly from the handle lever 1 thereby dismantling the grip member 19 from the handle lever 1.

As will be understood from the foregoing description, the handle structure of the present invention can be assembled with simple assembling work and, when required, the grip member 19 can be easily dismantled from the handle lever 1. Because the handle lever 1 is substantially covered by the grip member 19, the external appearance of the handle structure is improved, and due to the nature of the outwardly biased latching pawls 31 and 39 which abut against the outer member 21 and the handle lever 1, the assembled handle structure is free of play.

What is claimed is:

1. A handle structure comprising:

a handle lever;

a grip member having a recess formed therein and comprising ; a sleeve-like outer member and an inner member received in said outer member;

first means for achieving a latched engagement between said inner and outer members when said inner member is received in said outer member;

a latch opening formed in said handle lever;

an upper latch pawl defined by said inner member, said upper latch pawl falling into said latch opening to achieve a latched engagement between said grip member and said handle lever when said handle lever assumes a given position in said recess; and a window opening formed in said outer member and together with said latch opening exposing said upper latch pawl to the outside of said member when said upper latch pawl falls into said latch opening, wherein said upper latch pawl can be manipulated through said window opening to disengage said upper latch pawl from said latch opening.

2. A handle structure as claimed in claim 1, in which said first means comprises:

a latch recess formed on an inner surface of said outer member; and a lower latch pawl defined by said inner member, said lower latch pawl falling into said latch recess to achieve the latched engagement between said inner and outer members when said inner member assumes a given position in said outer member.

3. A handle structure as claimed in claim 2, in which, when no external stress is applied to said upper and lower latch pawls, said upper and lower latch pawls project outward beyond respective upper and lower major surfaces of said inner member.

4. A handle structure as claimed in claim 3, in which said outer and inner members are provided with guide means for guiding the insertion of said inner member into said outer member.

5. A handle structure as claimed in claim 4, in which said guide means comprises:

two guide ridges formed on opposed portions of the inner surface of said outer member; and two guide grooves formed on opposed portions of the outer surface of said inner member, said guide grooves being slidably engageable with said guide ridges.

6. A handle structure as claimed in claim 5, in which said inner member is formed at one axial end thereof with a wall, said wall closing one axial open end of said outer member when said inner and outer members are assembled.

7. A handle structure as claimed in claim 6, in which said inner member has a frame-like construction.

8. A handle structure as claimed in claim 7, in which said outer and inner members are constructed of plastic and said handle lever is constructed of metal.

9. A handle structure as claimed in claim 7, in which said outer member has a convex outer surface.

10. In a manual lock device having a handle lever which is pivotal between operative and inoperative positions, a grip member having a recess formed therein and comprising a sleeve-like outer member and an inner member received in said outer member;

first means for achieving a latched engagement between said inner and outer members when said inner member is received in said outer member;

a latch opening formed in said handle lever;

an upper latch pawl defined by said inner member, said upper latch pawl falling into said latch opening to achieve a latched engagement between said grip member and said handle lever when said handle lever assumes a given position in said recess; and a window opening formed in said outer member and together with said latch opening exposing said upper latch pawl to the outside of said grip member when said upper latch pawl falls into said latch opening, wherein said upper latch pawl can be manipulated through said window opening to disengage said upper latch pawl from said latch opening.

11. A detachable roof for a motor vehicle, comprising:

a roof proper;

a manual look device mounted on said roof proper, said look device having a handle lever which is pivotal between operative and inoperative positions; and a grip member detachably mounted on said handle lever, said grip member having a recess formed therein and including:

a sleeve-like outer member;

an inner member received in said outer member;

first means for achieving a latched engagement between said inner and outer members when said inner member is received in said outer member;

second means for achieving a latched engagement between said grip member and said handle lever when said handle lever of said lock device is inserted into said recess of said grip member; and third means for permitting said second means to be manipulated from the outside of said grip member in a manner to cancel the latched engagement between said grip member and said handle lever.

12. A detachable roof as claimed in claim 11, in which said third means comprises a window opening formed in said outer member, said window opening being so positioned as to expose said second means to the outside of said grip member.

* * * * *

UNITED STATES PATENT AND TRADEMARK OFFICE

CERTIFICATE OF CORRECTION

PATENT NO. : 5,088,781

DATED : FEBRUARY 18, 1992

INVENTOR(S) : ONO ET AL.

It is certified that error appears in the above-identified patent and that said Letters Patent is hereby corrected as shown below:

Claim 1, column 5, line 44, after "comprising" delete space;
line 57, after "said" add --grip--.

Claim 11, column 6, line 60, change "look" to --lock--;
column 6, line 61, change "look" to --lock--.

Signed and Sealed this

Eighth Day of June, 1993

*Attest:*

*Attesting Officer*

Michael K. Kirk

MICHAEL K. KIRK

*Acting Commissioner of Patents and Trademarks*